US005185904A

United States Patent [19]

Rogers et al.

[11] Patent Number: 5,185,904

[45] Date of Patent: Feb. 16, 1993

[54] PLASTIC CARRYING HANDLES

[75] Inventors: Frances C. Rogers, Kenmore; William L. Terzian, Williamsville, both of N.Y.

[73] Assignee: TeeWee, Inc., Williamsville, N.Y.

[21] Appl. No.: 798,732

[22] Filed: Nov. 27, 1991

[51] Int. Cl.[5] ..... A47B 95/02; B65D 5/10

[52] U.S. Cl. ..... 16/125; 16/110 R; 229/117.23; 294/27.1

[58] Field of Search ..... 229/117.23, 117.26; 206/390; 294/27.1; 16/110, 125

[56] References Cited

U.S. PATENT DOCUMENTS

| | | | |
|---|---|---|---|
| 1,524,399 | 1/1925 | Krueger | 294/27.1 |
| 2,006,786 | 7/1935 | Beauvisage | 229/52 |
| 2,158,697 | 5/1939 | Harrison | 229/52 |
| 2,236,681 | 4/1941 | Goldschmidt | 229/52 |
| 2,361,673 | 10/1944 | Young | 229/52 |
| 2,374,645 | 5/1945 | Borbe | 229/52 |
| 2,773,635 | 12/1956 | Stelzer | 229/52 |
| 2,959,342 | 11/1960 | Silverstein | 229/52 |
| 3,031,359 | 4/1962 | Blank et al. | 294/27.1 |
| 3,206,104 | 9/1965 | Cohen | 294/137 |

*Primary Examiner*—W. Donald Bray
*Attorney, Agent, or Firm*—Howard M. Ellis

[57] ABSTRACT

Flexible plastic carrying handle adapted for self-stick application as handling assist for large books, e.g. directories, catalogues and other disposable or renewable publications. The handles comprise a continuous contact base strip and a hand grip section formed as an integral one-piece article for more reliable adhesion and ease of application.

19 Claims, 1 Drawing Sheet

PLASTIC CARRYING HANDLES

BACKGROUND OF THE INVENTION

The present invention relates generally to carrying devices, and more specifically, to plastic handles for self-stick application as assists in gripping and transporting of large, bulky articles, such as oversized books, packages, and the like.

Most households and businesses receive each year a number of large books, such as telephone directories, consumer shopping catalogues, registries, parts catalogues, pages of information tables, charts, maps, etc., bound into large and heavy works of reference. Such directories and catalogues are not only cumbersome to store, but because of their size and weight can be particularly troublesome to securely grip when removing from or placing on a shelf or in a drawer. Because such disposable catalogues and directories are rarely, if ever, supplied with convenient gripping/carrying means, handling of them can be a difficult task, particularly for younger people and senior adults, and especially for the physically impaired. Individuals having, for example, arthritic hands and limbs with inflamed and swollen joints can experience pain in attempting grip and lift such heavy, oversized articles, and in some instances, becomes an almost impossible task.

Hence, various handling assists have been developed, including self-sticking carrying handles for packages, parcels, and various large articles. Preferred embodiments of disposable, self-stick handles providing for seemingly more reliable adhesion properties to articles are disclosed, for instance, in U.S. Pat. Nos. 3,206,104 and 2,158,697. The term "disposable" as used herein is intended to denote the carrying device when affixed to an article is retained in-tact for the expected useful life of the article. Thus, for purposes of the present invention a telephone directory having a self-stick carrying device would be expected to remain in-tact and be functional for the usual period of one (1) year, or until a new directory is published and distributed.

Both of the foregoing patents disclose handles for carrying articles comprising a base portion with an adhesive and a carrying handle bonded thereto, such as by heat sealing. These two piece type carrying handles, compared to single piece strip handles like those disclosed in U.S. Pat. Nos. 4,679,823 and 3,031,349, generally offer more reliable adhesion characteristics because the base section of the device which is bonded to the article provides more contact surface area. A single piece strip handle of the type disclosed in U.S. Pat. No. 3,031,359 provides for less contact surface area since only the terminal end sections adhere to the article.

One might conclude the two piece type handle design of U.S. Pat. No. 3,206,104 is a more reliable device. However, the self-adhering handle of this patent, while providing more contact surface area with the attached article, nevertheless, has been found to have certain shortcomings, making it less than a totally satisfactory carrying assist. In this regard, the hand gripping portion of the device is heat sealed to the contact base strip at its terminal ends. Consequently, when applied to the binding of a heavy object, such as a telephone directory the contact strip on a statistical basis is more prone to delaminate because most of the separation forces are localized at the terminal end sections of the base strip. A carrying handle of this type is more prone to peel from the article prematurely.

The solution to the increased potential for separation from the attached article would seem to be remedied by bonding the hand gripping portion to the base contact strip at points spaced away from the terminal ends. However, we discovered that in fabricating a flexible two piece plastic self-sticking carrying handle comprising a continuous contact base strip and an oval shaped handle portion heat sealed thereto at locations spaced from the terminal ends of the base strip a generally undesirable bowing of the carrying handle occurs, like that illustrated in FIG. 1, the details of which will be discussed further below. Suffice it to say at this point, that bowing of the plastic strip carrying handle makes application to an article a more difficult task, but more importantly, the bowing effect generates low level separation stresses between the contact base strip and the article it is attached to, which can, in turn, cause premature delamination of the handle from the article, particularly when there is some drying or aging of the adhesive. It has also been found that the number of process steps required in fabricating such a two-piece handle make it less economic as a disposable type carrying assist.

Accordingly, it would be highly desirable to have a more reliable carrying handle adapted for self-stick application, and which can also be fabricated more economically than previous devices. Such a carrying assist would be capable for use with heavy articles, economical so it would also be disposable, installed with minimum effort, remain securely in-tact and not be subject to premature delamination from the article it is attached.

SUMMARY OF THE INVENTION

Accordingly, it is a principal object of the invention to provide for low cost, reliable carrying assists in the form of plastic handles for attachment to heavy, bulky and cumbersome articles, such as large books, catalogues, directories, as well as packages and parcels for easier, more convenient handling of such articles.

The plastic carrying handles are adapted for self-stick application. Structurally, the handles include a continuous base section having first and second terminal ends and top and bottom surfaces. The carrying devices include a hand engageable section extending from the top surface of the base section which functions as the hand grip. However, instead of bonding the hand engageable section to the base section as through heat sealing the base and hand engageable sections are formed as an integral one-piece article. An adhesive backing is applied to the bottom side of the base section. The integral one-piece carrying handles are substantially planar and are not subject to bowing, and therefore, are more easily installed and less prone to premature delamination.

It is still a further object of the invention to provide for a molded one-piece carrying device for self-stick application wherein the hand engageable section joins the top surface of the base section at two locations spaced from one another, and more preferably, at two locations spaced from the first and second terminal ends of the base section for better adhesion to the attached article.

A still further object is to provide for a more economic thermoplastic carrying handle for self-stick application in which the bottom surface of the base section employs a pressure sensitive adhesive, and more specifically, a pressure sensitive tape with a double coated backing.

It is yet a further object of the invention to provide for an economic one-piece injection molded flexible plastic carrying handle for parcels and other large articles, which not only avoids the bowing effect associated with two-piece handles for more reliable bonding with the attached article, but includes embodiments where the base section is enlarged for even greater contact surface area.

These and other objects, features and advantages of the invention will become more apparent from the detailed written description below. However, for a further understanding of the invention, reference should first be made to the accompanying drawing taken in conjunction with the detailed written description below wherein.

DETAILED DESCRIPTION OF THE INVENTION

Figure 1:
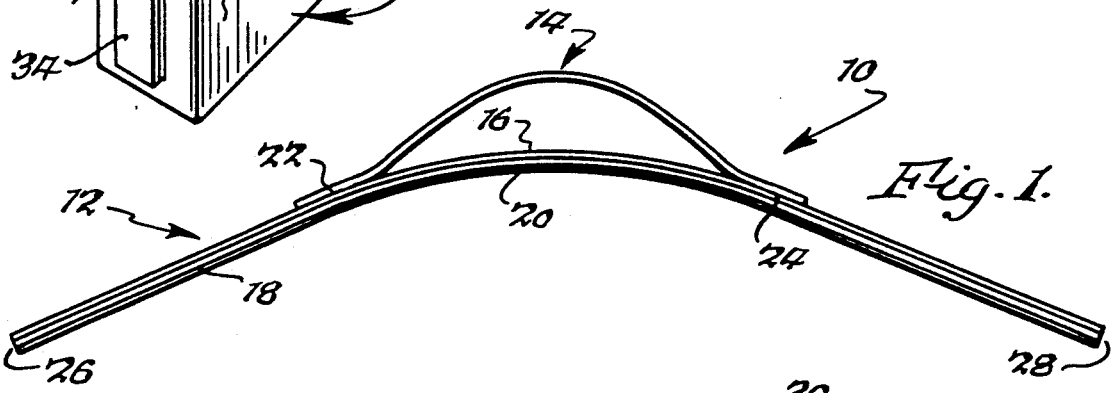
FIG 1 is a side elevational view of a bowed, flexible plastic two-piece carrying handle.

FIG. 1 illustrates the undesirable bowing effect which can occur when a flexible plastic carrying handle 10 is formed with a continuous base contact member 12 and a hand gripping member 14 bonded to top surface 16 of the base member. Handle 10 includes an adhesive backing 18 on bottom side 20 as the contact surface with the article, e.g. catalogue, directory (not shown). The oval shaped hand gripping member 14, as a separate fabrication step, is bonded to top surface 16 of the base by any conventional method, such as by heat sealing at points 22–24 spaced inwardly from terminal ends 26–28, to form the two-piece type bonded carrying handle. The bowed configuration may be the result of centrally positioning the hand gripping member relative to the base with the heat seals spaced from the terminal ends. This generates stresses along the base member causing it to bow and follow the oval shape of the handle.

Because of the continuous forces on handle 10 causing it to remain in a oval or bowed shape even when applied to a planar surface of an article there is an increased risk of the contact surface of the handle separating prematurely from the article attached. The bowed configuration of the carrying handle of FIG. 1 also makes application of the handle to an article a more difficult task.

Figure 2:
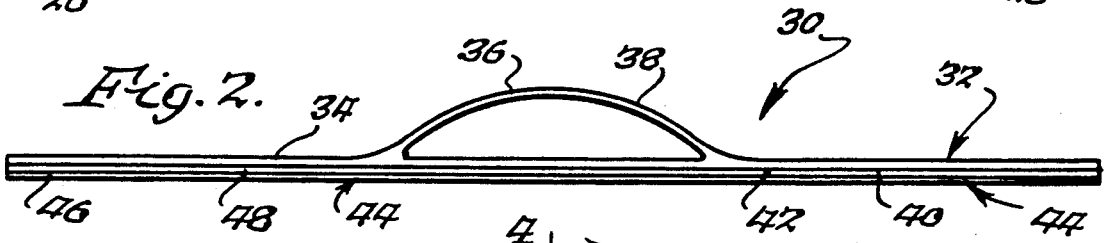
FIG. 2 is a side elevational view of the molded plastic one-piece carrying handle of the invention.
Figure 3:
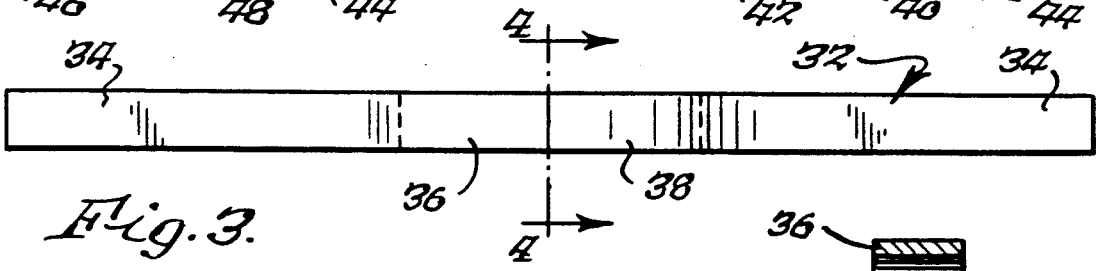
FIG. 3 is a top view of the molded plastic one-piece handle of FIG. 2.

By contrast, FIGS. 2–3 illustrate a molded one-piece plastic carrying handle 30 which in a relaxed condition remains substantially planar, and non-bowed. Because the carrying handle of FIGS. 2–3 remains substantially flat there is less risk of delamination, and application to an article is an easier task. Hence, the one-piece carrying handles of the present invention are more reliable and easier to use.

Carrying handle 30 consists of a continuous contact strip or base 32 which may be of any appropriate length, e.g. of sufficient length to run most of the length of the binding of a book/catalogue for maximizing adhesion thereto. Typically, the width of strip can be 0.5 inches or more. On the top surface 34 of strip 32 there is a gripping handle 36 in the form of a centrally positioned opened elevation which may be generally oval or loop shaped. In most instances, the width of gripping handle is the same as the contact strip. Dimensionally, rim 38 of gripping handle 36 is of sufficient height and length as to permit entry of several fingers for secure gripping.

Gripping handle 36 and contact strip 32 are formed as a one-piece unit thereby eliminating or reducing the stresses associated with the two-piece bonded handle. That is to say, the gripping handle of the invention is not bonded to the contact strip as by heat sealing, but the two elements are integral with one another, i.e. formed as a unit. This also makes the one-piece molded carrying handles more economic than two-piece type handles, since there is no need to weld the gripping handle to the base strip.

Preferably, the integral one-piece handles are fabricated as flexible plastic articles, but may also be fabricated from semi-rigid or even rigid plastics, if desired. In fabricating the integral one-piece carrying handles thermoplastics are satisfactory for most applications. Molding compositions may be used which comprise such representative polymers as polyolefins like polypropylene, high density polyethylene; high impact polystyrene; ABS resins, acrylics like methylacrylate and methylmethacrylate; vinyl plastics such as polyvinyl acetate, nylons, and the like. The polycarbonate resins have been found to be especially useful, and includes those available from General Electric Co. under the Lexan® trademark. The integral, one-piece carrying handles may be fabricated, for example, by standard methods known in the art of injection molding.

While thermoplastics are more economic and will be satisfactory for most carrying handle applications, the present invention also contemplates the use of thermosetting type plastics, such as the amino resins like urea-formaldehyde; phenolic type resins, and the like.

Figure 4:
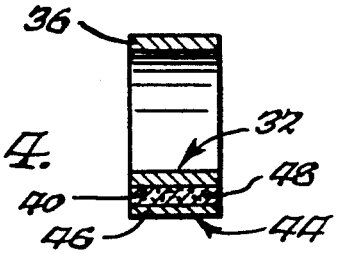
FIG. 4 is a sectional view of the one-piece plastic carrying handle taken along line 4—4 of FIG. 3.

The bottom side 40 of the contact strip 32 has an adhesive 42 (FIG. 2) which is preferably a pressure sensitive type. The expression "pressure sensitive adhesive" is intended to mean a surface which in a dry form is permanently tacky at room temperature and firmly adheres to another surface upon mere contact without requiring more than hand contact. While a coating of adhesive may be applied directly to the plastic bottom side 40 of strip 32, it is preferably applied in the form of a pressure sensitive tape 44 (best shown in FIG. 4) comprising a double coating of pressure sensitive adhesive 46. That is, adhesive on both sides of backing 48. Backing 48 is in the form of a foamed plastic, such as a polyurethane type foam. A useful line of double coated pressure sensitive foamed tapes is available from 3M Company under the trademark Scotch-Mount®.

Figure 5:
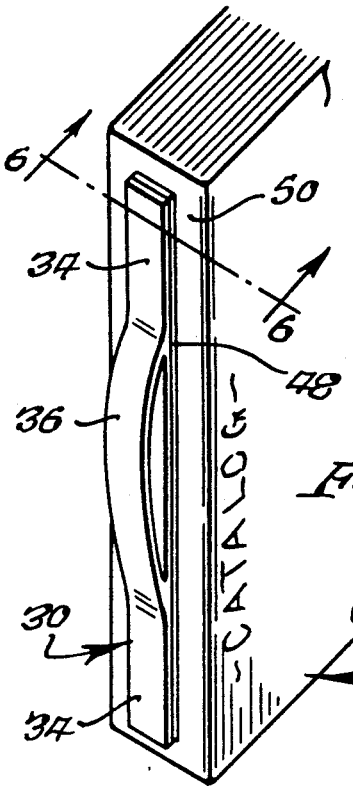
FIG. 5 is a perspective view of the one-piece carrying handle of the invention affixed to the binding of a catalogue.

While not shown, the outer adhesive layer 46 of pressure sensitive tape 44 has a strippable protective paper backing which is removed prior to affixing the handle to the article, like that shown in FIG. 5.

Figure 6:
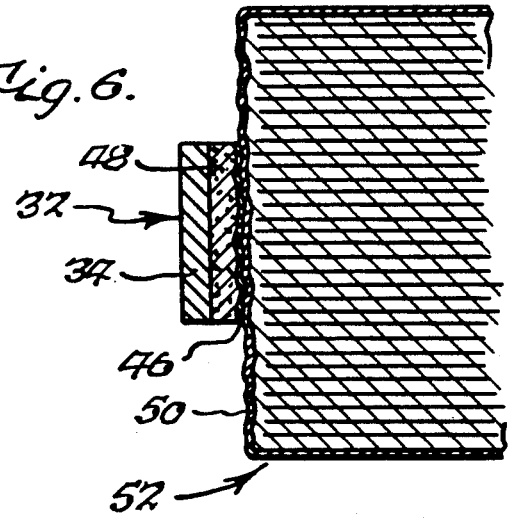
FIG. 6 is a sectional view of the carrying handle of the invention taken along line 6—6 of FIG. 5.

One method of applying carrying handle 30 to large bound publications is to position it longitudinally with binding 50 of catalogue 52 (FIG. 5) and press it s the adhesive 46 makes full contact along the entire length of the contact strip 32. Frequently, bindings 50 of catalogues, directories and other similar type publications are rough and uneven, as best illustrated by FIG. 6. The foamed backing 48 of the double coated pressure sensitive tape has been found to be especially useful as a leveler for uneven binding surfaces. The resilient foam backing maximizes surface contact of the adhesive with the high points and grooves of the binding, further enhancing the reliability of the handles.

The embodiments of the integral one-piece carrying handles illustrated in the drawings are shown with contact base strips and gripping handles having the same width. However, it is to be understood the invention and appended claims also comtemplate embodiments of carrying handles in which the contact base strip is enlarged, e.g. made wider than the gripping handle for even more contact surface area.

While the invention has been described in conjunction with various examples and embodiments, they are illustrative only. Accordingly, many alternatives, modifications and variations will be apparent to persons skilled in the art in light of the foregoing detailed description, and it is therefore intended to embrace all such alternatives, modifications and variations as to fall within the spirit and broad scope of the appended claims.

We claim:

1. A plastic carrying handle, which comprises a continuous base section having first and second terminal ends with opposite top and bottom surfaces, a hand engageable section comprising a central gripping portion extending from said top surface of said base section, said hand engageable section joined with said base at two locations on said top surface spaced from one another and indented inwardly from said first and second terminal ends, said base and hand engageable sections formed as an integral one-piece article, and an adhesive backing on said bottom surface of said base section.

2. The plastic carrying handle of claim 1 wherein said hand engageable section is generally oval shaped.

3. The plastic carrying handle of claim 1 wherein said hand engageable section is generally loop shaped.

4. The plastic carrying handle of claim 1 wherein said adhesive backing is a pressure sensitive tape.

5. The plastic carrying handle of claim 4 wherein the pressure sensitive tape comprises a double coated backing.

6. The plastic carrying handle of claim 1 wherein the adhesive backing is a double coated pressure sensitive foam tape.

7. The plastic carrying handle of claim 1 wherein the base section and hand engageable section are injection molded into a one-piece article.

8. The plastic carrying handle of claim 7 fabricated from a plastic comprising a thermoplastic polymer.

9. The plastic carrying handle of claim 8 which is substantially flexible.

10. The plastic carrying handle of claim 7 fabricated from a plastic comprising a thermosetting polymer.

11. The plastic carrying handle of claim 10 which is substantially rigid.

12. The plastic carrying handle of claim 5 wherein the width of said hand engageable section and said base section are substantially the same.

13. The plastic carrying handle of claim 5 wherein the width of said base section is greater than the width of hand engageable section.

14. The plastic carrying handle of claim 1 wherein the hand engageable section and said base section are parallel with one another.

15. A plastic carrying handle, which comprises a continuous base section having first and second terminal ends with opposing top and bottom surfaces, gripping handle means comprising a centrally positioned elevation extending from said top surface of said base section, said gripping handle means and said continuous base section being formed into an integral one-piece article by molding means, and means for affixing said carrying handle to an article.

16. The carrying handle of claim 15 formed into a semi-rigid plastic article.

17. The carrying handle of claim 15 wherein said means for affixing to an article comprises a pressure sensitive adhesive applied to said bottom surface of said base section.

18. The carrying handle of claim 17 wherein said pressure sensitive adhesive comprises a tape.

19. The carrying handle of claim 15 formed by injection molding means.

* * * * *